US010036212B2

(12) United States Patent
Gourmelon

(10) Patent No.: US 10,036,212 B2
(45) Date of Patent: Jul. 31, 2018

(54) ROPE SOCKET ASSEMBLY AND WIRELINE LOGGING HEADS INCLUDING SAME

(71) Applicant: Schlumberger Technology Corporation, Sugar Land, TX (US)

(72) Inventor: Pierre-Olivier Gourmelon, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 182 days.

(21) Appl. No.: 15/187,878

(22) Filed: Jun. 21, 2016

(65) Prior Publication Data

US 2017/0362902 A1 Dec. 21, 2017

(51) Int. Cl.

| | |
|---|---|
| ***E21B 17/02*** | (2006.01) |
| ***E21B 23/14*** | (2006.01) |
| ***E21B 47/06*** | (2012.01) |
| ***H01R 4/22*** | (2006.01) |

(52) U.S. Cl.
CPC ..... *E21B 17/028* (2013.01); *E21B 47/065* (2013.01); *H01R 4/22* (2013.01)

(58) Field of Classification Search
CPC ..... E21B 17/023; E21B 17/028; E21B 23/14; E21B 47/01
USPC ..... 166/385, 241.5; 294/86.1
See application file for complete search history.

(56) References Cited

U.S. PATENT DOCUMENTS

| | | | | |
|---|---|---|---|---|
| 4,685,516 | A * | 8/1987 | Smith | E21B 17/023 166/385 |
| 4,877,089 | A * | 10/1989 | Burns | E21B 17/023 166/117 |
| 6,032,733 | A | 3/2000 | Ludwig et al. | |
| 6,098,017 | A | 8/2000 | Brown et al. | |
| 6,712,146 | B2 | 3/2004 | Estep et al. | |
| 7,409,987 | B2 | 8/2008 | Fjelde | |
| 7,426,964 | B2 | 9/2008 | Lynde et al. | |
| 7,699,114 | B2 * | 4/2010 | Ullah | G01V 11/002 166/385 |
| 7,819,198 | B2 | 10/2010 | Birckhead et al. | |
| 7,913,768 | B2 | 3/2011 | Hallundbaek et al. | |
| 8,230,932 | B2 | 7/2012 | Ratcliffe et al. | |
| 8,347,964 | B2 | 1/2013 | Fisher et al. | |
| 8,443,902 | B2 | 5/2013 | Evans | |
| 8,496,065 | B2 | 7/2013 | McCarter et al. | |
| 8,540,021 | B2 | 9/2013 | McCarter et al. | |
| 8,789,579 | B2 | 7/2014 | Ollerenshaw et al. | |
| 9,458,695 | B2 * | 10/2016 | Hallundbæk | E21B 43/1195 |

(Continued)

*Primary Examiner* — Kenneth L Thompson
(74) *Attorney, Agent, or Firm* — Sara K. M. Hinkley

(57) ABSTRACT

A rope socket assembly, wireline logging heads that include the rope socket assembly, and processes for assembling same. In some examples, the rope socket assembly for a wireline logging head can include a housing, a retainer, a rope socket, a separator, a seal, a pressure cap, a sleeve, a pressure compensating piston at least partially disposed about the sleeve, an electrical bulkhead housing disposed within the sleeve, and a conductor bundle disposed within the electrical bulkhead housing. The conductor bundle can include a plurality of terminals configured to receive a plurality of wires from a wireline and form an electrical connection therebetween. Each terminal can be configured to seal a terminal end of one of the plurality of wires from the wireline.

20 Claims, 3 Drawing Sheets

(56) References Cited

U.S. PATENT DOCUMENTS

| | | | | |
|---|---|---|---|---|
| 9,765,575 | B2 * | 9/2017 | Hradecky | E21B 17/028 |
| 2011/0259601 | A1 | 10/2011 | Withers | |

* cited by examiner

ROPE SOCKET ASSEMBLY AND WIRELINE LOGGING HEADS INCLUDING SAME

FIELD

Embodiments described generally relate to a rope socket assembly for wireline logging heads, wireline logging heads that include the rope socket assembly, and methods for assembling same.

BACKGROUND

Wirelines are used to lower wireline logging heads into boreholes and an electrical connection is used to connect one or more wireline logging tools in the wireline logging head to surface electrical equipment. Such wirelines can be routed through a pulley or sheave at the upper level of a drilling rig, and spooled on a reel in the wireline surface unit. From the reel, wiring can connect the wireline logging head to other surface equipment.

A rope socket assembly is one unit that can mechanically connect the wireline logging head to the wireline and also electrically connect the one or more wireline logging tools to the wireline. Making the electrical connections from the wireline to the wireline logging tool is time consuming and the electrical connections are prone to failure if a downhole fluid flows into the electrical bulkhead that houses the electrical connections.

SUMMARY

A rope socket assembly, wireline logging heads that include the rope socket assembly, and processes for assembling same are provided. In some examples, the rope socket assembly can include a housing that can include a body having a bore formed therethrough and an end cap coupled to a first end of the body. A retainer can be least partially disposed within the bore proximate a second end of the body. The retainer can secure a wireline therein. The wireline can include a plurality of individual wires. A rope socket can be disposed within the bore and can have a first end and a second end. The first end of the rope socket can be adjacent the retainer. The rope socket can receive the plurality of individual wires. A separator can be at least partially disposed within the rope socket and can separate the plurality of individual wires. A seal can be at least partially disposed within the rope socket. A pressure cap can be coupled to the second end of the rope socket, thereby compressing the seal and retaining the separator at least partially within the rope socket. A sleeve can be disposed within the bore adjacent the second end of the rope socket. A pressure compensating piston can be at least partially disposed about the sleeve. An electrical bulkhead housing can be disposed within the sleeve. A conductor bundle can be disposed within the electrical bulkhead housing. The conductor bundle can include a plurality of terminals that can receive the plurality of wires and form an electrical connection therebetween. Each terminal can seal a terminal end of one of the plurality of wires. The end cap can secure the conductor bundle within the electrical bulkhead housing.

In some examples the wireline logging head can include the rope socket assembly, a load cell, a lower housing, and an electronics cartridge. The load cell can have a first end and a second end. The first end of the load cell can be coupled to the end cap of the housing of the rope socket. The lower housing can have a first section detachably coupled to a second section. The first section of the lower housing can be coupled to the second end of the load cell. The electronics cartridge can be at least partially disposed within the second section of the lower housing.

In some examples, the process for assembling the wireline logging head can include coupling a first end of the load cell to the end cap of the housing of the rope socket assembly. The process can also include coupling the first section of the lower housing to the second end of the load cell. The process can also include disposing the electronics cartridge at least partially within the second section of the lower housing.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
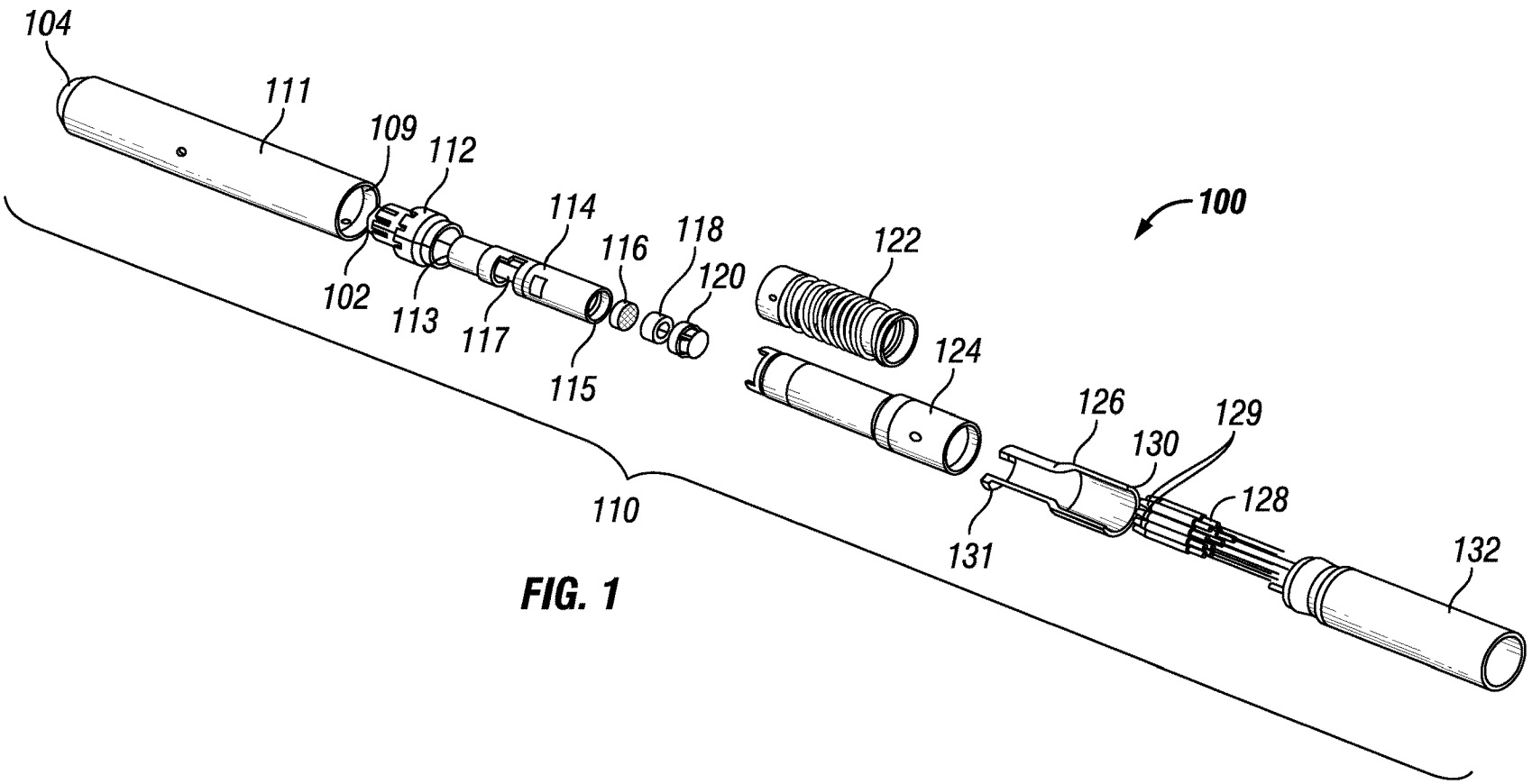
FIG. 1 depicts an exploded view of an illustrative rope socket assembly, according to one or more embodiments described.

FIG. 1 depicts an exploded view of an illustrative rope socket assembly 100, according to one or more embodiments. The rope socket assembly 100 can include a housing 110, a retainer 112, a rope socket 114, a separator 118, a seal 116, a pressure cap 120, a sleeve 124, a pressure compensating piston 122, a conductor bundle 128, and an electrical bulkhead housing 126. The housing 110 can be or include a body 111 and an end cap 132. The body 111 of the housing 110 can have a bore 109 formed therethrough and the end cap 132 can be coupled to a first end 102 of the body 111. The retainer 112 can secure a wireline that can include a plurality of individual wires. The rope socket 114 can receive the wireline and can separate the plurality of individual wires via the separator 118. The separated wires can pass from the rope socket 114 and into the electrical bulkhead housing 126. The conductor bundle 128 can be at least partially disposed within the electrical bulkhead housing 126. The electrical bulkhead housing 126 can be at least partially disposed within the sleeve 124. The conductor bundle 128 can include a plurality of terminals 129 that can receive the plurality of wires to form an electrical connection therebetween.

Each terminal in the plurality of terminals 129 can seal a terminal end of one of the plurality of wires. For example, each terminal in the plurality of terminals 129 can form a liquid tight seal, a gas tight seal, or a liquid and gas tight seal around the terminal end of each wire. In one example, the seal can prevent a fluid, e.g., a downhole gas and/or a downhole liquid, from contacting the terminal ends of the wires sealed within the terminals 129. Illustrative downhole fluids can include, but are not limited to, water-based drilling fluids, base fluids (e.g., fresh water, sea water, brine, saturated brine, and/or formate brine) used in non-dispersed systems containing natural clays or in dispersed systems containing chemical dispersants such as ligosulfonates, lignitic additives, tannins, and/or caustic soda; polymer-based drilling fluids; oil-based drilling fluids (e.g., diesel, mineral oil, and/or linear olefins and paraffins); synthetic-based drilling fluids that can include linear alpha-olefins (LAO) and isomerized olefins (IO); pneumatic-drilling fluids (e.g., air or other gases); and subterranean hydrocarbon liquids, hydrocarbon gases, inorganic compounds, and/or organic compounds; and mixture thereof.

The plurality of terminals 129 can be made of or include one or more electrically insulating or electrically non-conductive materials. Illustrative electrically insulating or electrically non-conductive materials can be or include, but are not limited to, polytetrafluoroethylene (PTFE), perfluoroalkoxy alkanes (PFA), polyetheretherketones (PEEK), polyvinyl chloride (PVC), ceramic clay, porcelain clay, cresyl phthalates, bis(2-ethylhexyl) phthalate (DEHP), polyethylenes, polypropylenes, copolymers of hexafluoropropylene (HFP) and vinylidene fluoride (VDF), terpolymers of tetrafluoroethylene (TFE), vinylidene fluoride (VDF), and hexafluoropropylene (HFP), perfluoromethylvinylether (PMVE), rubber, glass (e.g., silica glass, soda ash glass, and limestone glass), or any combination thereof. In at least one example, the plurality of terminals 129 can be made of polyvinyl chloride, copolymers of vinylidene fluoride, terpolymers of vinylidene fluoride, perfluoromethylvinylether, or any combinations thereof.

The electrical bulkhead housing 126 can have a first end and a second end. The first end and/or the second end of the electrical bulkhead housing 126 can include one or more ports (two are shown, 130 and 131). In one example, the first port 130 can facilitate the injection of an electrically insulating material, e.g., a non-conductive fluid, into the electrical bulkhead housing 126 and the second port 131 can facilitate the removal of gas, e.g., air, while filling. In another example, the second port 131 can be used to apply a vacuum that can be used to draw the electrically insulating material through the first port 130 and into the electrical bulkhead housing 126. The non-conducting fluid can be contained within the electrical bulkhead housing 126 about the conductor bundle 128. The non-conducting fluid, such as a non-conducting oil, can insulate or otherwise further isolate the plurality of individual wires within the conductor bundle 128. For example, the non-conductive oil can act as a barrier to downhole fluids that may flow into the electrical bulkhead housing 126. Where pressure, at least in part, causes the downhole fluids to flow into the electrical bulkhead housing 126, the pressure compensating piston 122 can act to reduce the driving force, and thereby reduce or prevent the introduction of downhole fluids into the electrical bulkhead housing 126. Illustrative electrically insulating materials that can be disposed within the electrical bulkhead housing 126 and about the conductor bundle 128 can be or include, but are not limited to, mineral oil, castor oil, silicone oil, fluorinated hydrocarbons, or any mixture thereof.

The retainer 112 can be at least partially disposed within the bore 109 of the body 111. For example, the retainer 112 can be disposed within the bore 109 of the body 111 and proximate a second end 104 of the body 111. The retainer 112 can be configured to secure the wireline therein. In one example, the retainer 112 can be a wedge-type retainer that provide a wedging action that can grip an end of a wireline to secure the wireline in a stationary position within the rope socket assembly 100. Other suitable types of retainers can include, but are not limited to, ring-type retainers, cone-type retainers, and split-type retainers. The terminal ends of the wireline can be fed through the bore 109 of the rope socket assembly 100. The retainer 112 can be at least partially disposed within the bore 109 of the housing 110 toward or proximate a second end of the body 104.

The rope socket 114 can be at least partially disposed within the bore 109 of the housing 110. The rope socket can have a first end 113 and a second end 115, where the first end 113 of the rope socket 114 can be adjacent the retainer 112. The rope socket 114 can be configured to receive the plurality of individual wires from the wireline. For example, the rope socket 114 can have a bore formed therethrough to provide passage of the terminal end of the wireline that can be passed therethrough. The rope socket 114 can have any desired cross-sectional shape. In one example, the rope socket 114 can be a cylindrically shaped body having the bore formed therethrough. The rope socket 114 can include a swivel mandrel, allowing rotation of the wireline at least partially disposed within. The rope socket 114 can have a side opening or access port 117 to provide access to the wireline when disposed therein.

The seal 116 can be an O-ring type seal or any other shaped seal that can form a fluid tight seal about the wireline when disposed within the rope socket 114. Other sealing mechanisms, such as packing rings, can also be employed. The seal 116 can be fabricated from one or more elastomeric materials, including, but not limited to, hydrogenated nitrile or HNBR (hydrogenated acrylonitrile butadiene), tetrafluoroethylene, copolymers of hexafluoropropylene (HFP) and vinylidene fluoride (VDF), terpolymers of tetrafluoroethylene (TFE), vinylidene fluoride (VDF), and hexafluoropropylene (HFP), perfluoromethylvinylether (PMVE), perfluoroelastomers, or any combination thereof. Suitable commercially available elastomeric materials can include, but are not limited to, those sold under the tradenames VITON®, KALREZ®, and CHEMRAZ®.

The separator 118 can be at least partially disposed or seated within the rope socket 114 and can be configured to separate the plurality of individual wires of the wireline. The separator 118 can have a cross-sectional shape that can generally correspond to an inner cross-sectional shape of the rope socket housing 110. For example, if the bore formed through the rope socking hosing 110 is circular, the separator 118 can have a circular cross-sectional shape. The separator 118 can include a plurality of holes disposed therethrough. The number of holes can be at least equal to the number of wires in the plurality of wires that make up the wireline. The individual wires of the wireline can be separated apart from one another by feeding the individual wires through the holes disposed through the separator 118.

In one or more examples, the separator 118 can be made of one or more electrically insulating materials. Illustrative electrically insulating materials can include, but are not limited to, polytetrafluoroethylene (PTFE), perfluoroalkoxy alkanes (PFA), polyetheretherketones (PEEK), polyvinyl chloride (PVC), ceramic clay, porcelain clay, cresyl phthalates, bis(2-ethylhexyl) phthalate (DEHP), polyethylenes, polypropylenes, copolymers of hexafluoropropylene (HFP) and vinylidene fluoride (VDF), terpolymers of tetrafluoroethylene (TFE), vinylidene fluoride (VDF), and hexafluoropropylene (HFP), perfluoromethylvinylether (PMVE), rubber, glass (e.g., silica glass, soda ash glass, and limestone glass), mica, or any combination thereof.

The pressure cap 120 can be coupled to the second end 115 of the rope socket 114, thereby compressing the seal 116 and retaining the separator 118 within the bore of the rope socket 114. The pressure cap 120 can have a passage or bore formed therethrough that can allow passage of the separated wires of the wireline. The pressure cap 120 can have a cross-sectional shape that corresponds to the cross-sectional shape of the rope socket housing 110. For example, if the rope socket housing 110 is circular, the pressure cap 120 can have a circular cross-sectional shape. The pressure cap 120 can be secured to the rope socket 114 via any desired connection. In one example, the pressure cap 120 can threadably couple to an inner surface of the rope socket 114.

The sleeve 124 can be at least partially disposed within the bore of the body 111. In one example, the sleeve 124 can be disposed within the bore of the body 111 and adjacent the second end 115 of the rope socket 114. The pressure compensating piston 122 can be at least partially disposed about the sleeve 124 and the electrical bulkhead housing 126 can be at least partially disposed within the sleeve 124. The sleeve 124 can have a cross-sectional shape that corresponds to an inner cross-sectional shape of the rope socket housing 110. For example, if the bore formed through the rope socket housing 110 is circular, the sleeve 124 can have a circular cross-sectional shape.

As depicted in FIG.1, the pressure compensating piston 122 can be an annular piston that can include an elastic element. In some examples, the pressure compensating piston 122 can include one or more springs that can apply a biasing force to a piston, which can act to resist axial displacement of the annular piston, should an increase in pressure of well fluids occurs. The pressure compensating piston 122 can be configured to act as a dashpot that is biased by an elastic element or elements, such as one or more springs.

In one or more examples, the body 111, the end cap 132, the retainer 112, the rope socket 114, pressure cap 120, pressure compensating piston 122, and electrical bulkhead housing 126 can be made of or include one or more materials that are resistant to corrosion by the environment in which the rope socket assembly 100 may be exposed during use. Illustrative corrosion resistant materials can include, but are not limited to, steel, stainless steel, heat-treated steel, coated steel, iron, nickel, chromium, aluminum, titanium, copper, brass, any alloy thereof, one or more ceramic materials, glass, polymeric materials, or any combination thereof.

Figure 2:
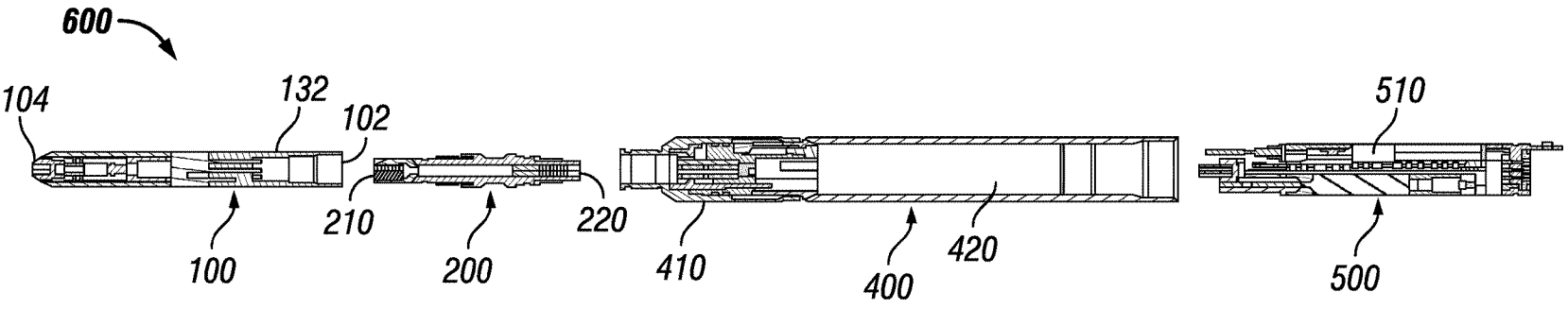
FIG. 2 depicts an exploded cross-sectional side view of an illustrative wireline logging head according to one or more embodiments described.
Figure 3:
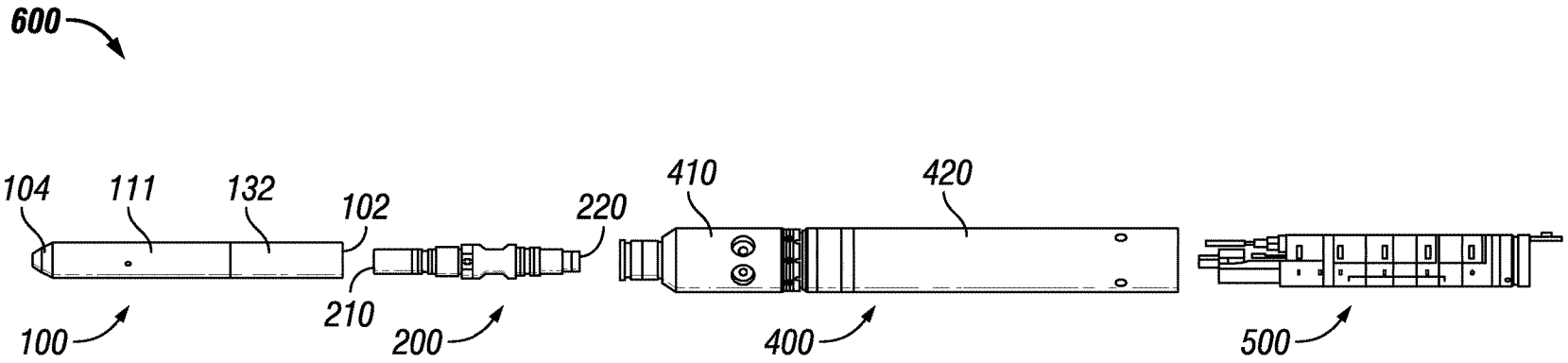
FIG. 3 depicts an exploded side view of the illustrative wireline logging head shown in FIG. 2.

FIG. 2 depicts an exploded cross-sectional side view of an illustrative wireline logging head 600 and FIG. 3 depicts an exploded side view of the illustrative wireline logging head 600 shown in FIG. 2, according to one or more embodiments. The wireline logging head 600 can include the rope socket assembly 100, a load cell 200, a lower housing 400, and an electronics cartridge 500.

The load cell 200 can have a first end 210 and a second end 220. In one example, the first end 210 of the load cell 200 can be coupled to the end cap 132 of the housing 110 of the rope socket assembly 100. For example, the first end 210 of the load cell 200 can be threadably coupled to the end cap 132 of the housing 110 of the rope socket assembly 100. The load cell 200 can be of various types, including hydraulic, pneumatic, or strain gauge. The load cell 200 can acquire downhole load data relative to a downhole location in the well. The load 200 can detect both traverse load and axial load relative to the well.

The lower housing 400 can include a first section 410 coupled to a second section 420. In one example, the first section 410 and the second section 420 can be detachably coupled to one another. In another example, the first section 410 and the second section 420 can be detachably and rotatably coupled to one another. In another example, the first section 410 and the second section 420 can be coupled to one another by a threaded ring and eyed to one another. The first section 410 of the lower housing 400 can be coupled to the second end 220 of the load cell 200. In one example, the first section 410 of the lower housing 400 can be coupled to the second end 220 of the load cell 200 in a manner that can permit the lower housing 400 and the load cell 200 to be uncoupled from one another and recoupled to one another. For example, a motor 510 can be at least partially disposed within the lower housing 400. The motor 510 an uncouple the lower housing 400 from the load cell 200 when operated in a first direction and can couple the lower housing 400 to the load cell 200 when operated in a second direction. For example, the motor 510 can move one or more dog legs into a disengaged or uncoupled position relative to the load cell 200 when operated in the first direction. When operated in the second direction the motor 510 can move the one or more dog legs into an engaged or coupled position relative to the load cell 200.

The rope socket assembly 100, the load cell 200, and the lower housing 400 can be detachable from one another. The electrical connection formed between the plurality of terminals 129 of the conductor bundle 128 and the plurality of wires of the wireline can be maintained when any one of the rope socket assembly 100, the load cell 200, and the lower housing 400 is detached from the wireline logging head 600. For example, the electrical connection formed between the plurality of terminals 129 of the conductor bundle 128 and the plurality of wires of the wireline can be maintained when the rope socket assembly 100 is uncoupled form the load cell 200.

The load cell 200 and/or the lower housing 400 can be made of one or more materials that are resistant to corrosion by the environment in which the rope socket assembly 100 can be exposed to during use. For example, load cell 200 and/or the lower housing 400 can be fabricated from, but not limited to, one or more of: steel, stainless steel, heat-treated steel, coated steel, iron, nickel, chromium, aluminum, titanium, copper, brass, any alloys or combinations thereof, a ceramic material, a glass material, a polymeric material, or any combination thereof.

The electronics cartridge 500 can be at least partially disposed within the second section 420 of the lower housing 400. The electronics cartridge 500 can include a variety of electronics and power supplies, including one or more resistance temperature detectors (RTDs), one or more downhole modems for a digital telemetry system, and one or more sensor controllers, or any combination thereof. The electronics cartridge 500 can perform a variety of electronics power functions, including, but not limited to providing power at appropriate levels, receiving and processing sensor output signals, and performing data reduction, or any combination thereof.

Figure 4:
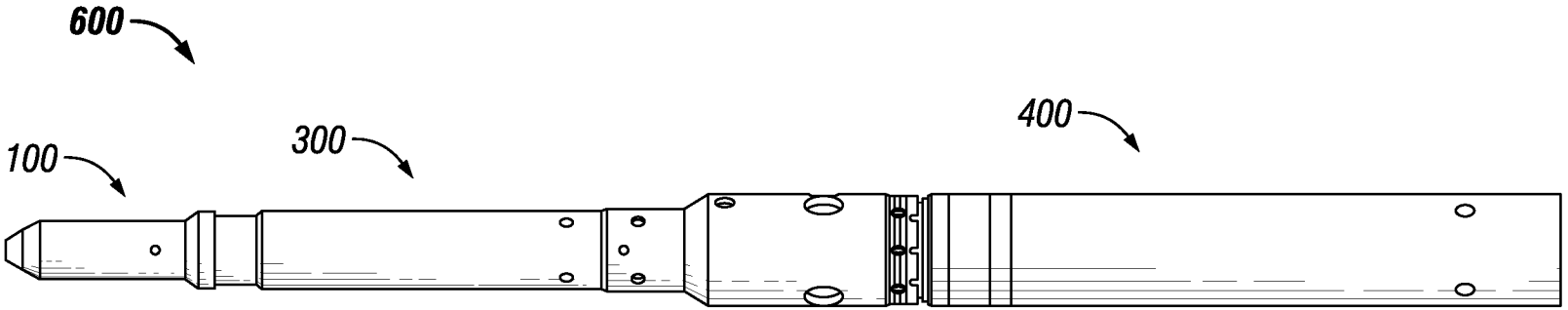
FIG. 4 depicts an illustrative side view of the wireline logging head shown in FIGS. 2 and 3.

FIG. 4 depicts an illustrative wireline logging head 600 that includes a fishing module 300. For example, the fishing module 300 can be coupled to an outer service of the first section 410 of the lower housing 400 and can be disposed about at least a portion of the rope socket assembly 100. The fishing module 300 can be one of a variety of fishing modules 300, including, but not limited to, a fishing bell housing, a housing with an external fishing neck, or a housing with an internal fishing neck. The fishing module 300 can be made of one or more materials that are resistant to corrosion by the environment in which the rope socket assembly 100 can be exposed to during use. For example, it can be fabricated from, but not limited to, one or more of: steel, stainless steel, heat-treated steel, coated steel, iron, nickel, chromium, aluminum, titanium, copper, brass, any alloys or combinations thereof, a ceramic material, a glass material, a polymeric material, or any combination thereof.

An illustrative process for assembling the wireline logging head 600 can include coupling a first end 210 of a load cell 200 to an end cap 132 of the housing 110 of the rope socket assembly 100. The conductor bundle 128 can include a plurality of terminals 129 that can be in contact with the plurality of wires to form an electrical connection therebetween. Each terminal 129 can seal a terminal end of one of the plurality of wires. The process can also include coupling the first section 410 of the lower housing 400 to a second end 220 of the load cell 200. The process can also include disposing the electronics cartridge 500 within the second section 420 of the lower housing 400. In at least one example, the first end 210 of the load cell 200 can be uncoupled from the end cap 132 of the housing 110 of the rope socket assembly 100 and the electrical connection can be maintained when the rope socket assembly 100 is uncoupled from the load cell 200.

Embodiments described herein further relate to any one or more of the following paragraphs:

1. A rope socket assembly for a wireline logging head, comprising: a housing comprising a body having a bore formed therethrough and an end cap coupled to a first end of the body; a retainer at least partially disposed within the bore proximate a second end of the body, wherein the retainer is configured to secure a wireline therein, the wireline comprising a plurality of individual wires; a rope socket disposed within the bore and having a first end and a second end, wherein the first end of the rope socket is adjacent the retainer, and wherein the rope socket is configured to receive the plurality of individual wires; a separator at least partially disposed within the rope socket and configured to separate the plurality of individual wires; a seal at least partially disposed within the rope socket; a pressure cap coupled to the second end of the rope socket, thereby compressing the seal and retaining the separator at least partially within the rope socket; a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires and form an electrical connection therebetween, wherein each terminal is configured to seal a terminal end of one of the plurality of wires, and wherein the end cap secures the conductor bundle within the electrical bulkhead housing.

2. A wireline logging head, comprising: a rope socket assembly comprising: a housing comprising a body having a bore formed therethrough and an end cap coupled to a first end of the body; a retainer at least partially disposed within the bore proximate a second end of the body, wherein the retainer is configured to secure a wireline therein, the wireline comprising a plurality of individual wires; a rope socket disposed within the bore and having a first end and a second end, wherein the first end of the rope socket is adjacent the retainer, and wherein the rope socket is configured to receive the plurality of individual wires; a separator at least partially disposed within the rope socket and configured to separate the plurality of individual wires; a seal at least partially disposed within the rope socket; a pressure cap coupled to the second end of the rope socket, thereby compressing the seal and retaining the separator at least partially within the rope socket; a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires to form an electrical connection therebetween, and wherein each terminal in the plurality of terminals comprises a seal that seals a terminal end of one of the plurality of wires, and wherein the end cap secures the conductor bundle within the electrical bulkhead housing; a load cell having a first end and a second end, wherein the first end of the load cell is coupled to the end cap of the housing of the rope socket; a lower housing having a first section detachably coupled to a second section, wherein the first section of the lower housing is coupled to the second end of the load cell; and an electronics cartridge at least partially disposed within the second section of the lower housing.

3. The rope socket assembly or the wireline logging head according to paragraph 1 or 2, wherein the electrical bulkhead housing contains an electrically non-conducting material about the conductor bundle disposed within the electrical bulkhead housing.

4. The rope socket assembly or the wireline logging head according to any one of paragraphs 1 to 3, wherein the electrical bulkhead housing contains an electrically non-conducting fluid disposed about the conductor bundle.

5. The rope socket assembly or the wireline logging head according to any one of paragraphs 1 to 4, wherein the end cap of the rope socket housing comprises a connector configured to couple to a load cell module.

6. The rope socket assembly or the wireline logging head according to any one of paragraphs 1 to 5, wherein the rope socket housing comprises a connector configured to threadably couple to a load cell module.

7. The rope socket assembly or the wireline logging head according to any one of paragraphs 1 to 6, wherein each seal that seals the terminal end of one of the plurality of wires comprises an elastomer.

8. The rope socket assembly or the wireline logging head according to any one of paragraphs 1 to 7, wherein each seal that seals the terminal end of one of the plurality of wires forms a liquid tight seal about the terminal end of the wire.

9. The rope socket assembly or the wireline logging head according to any one of paragraphs 1 to 8, wherein each seal that seals the terminal end of one of the plurality of wires forms a liquid and gas tight seal about the terminal end of the wire.

10. The rope socket assembly or the wireline logging head according to any one of paragraphs 1 to 9, wherein each seal that seals the terminal end of one of the plurality of wires is electrically non-conductive.

11. The rope socket assembly or the wireline logging head according to any one of paragraphs 1 to 10, wherein the retainer is a wedge-type retainer, a ring-type retainer, a cone-type retainer, or a split-type retainer.

12. The wireline logging head according to any one of paragraphs 2 to 11, further comprising a fishing module coupled to an outer surface of the first section of the lower housing.

13. The wireline logging head according to any one of paragraphs 2 to 12, wherein the fishing module is a fishing bell housing, a housing with an external fishing neck, or a housing with an internal fishing neck.

14. The wireline logging head according to any one of paragraphs 2 to 13, wherein the rope socket assembly, the load cell, and the lower housing are detachable from one another, and wherein the electrical connection is maintained when any one of the rope socket assembly, the load cell, and the lower housing is detached from the wireline logging head.

15. The wireline logging head according to any one of paragraphs 2 to 14, wherein the electrical connection is maintained when the rope socket assembly is uncoupled from the load cell.

16. The wireline logging head according to any one of paragraphs 2 to 15, wherein a motor is at least partially disposed within the lower housing and configured to uncouple the lower housing from the load cell when operated in a first direction and to couple the lower housing to the load cell when operated in a second direction.

17. The wireline logging head according to any one of paragraphs 2 to 16, wherein the first section of the lower housing is rotatably connected to the second section of the lower housing.

18. The wireline logging head according to any one of paragraphs 2 to 17, wherein the electronics cartridge includes a resistance temperature detector.

19. A process for assembling a wireline logging head, comprising: coupling a first end of a load cell to an end cap of a housing of a rope socket assembly; coupling a first section of a lower housing to a second end of the load cell, wherein the lower housing comprises the first section and a second section that are detachably coupled to one another; and disposing an electronics cartridge within the second section of the lower housing, wherein the rope socket assembly comprises: a housing comprising a body having a bore formed therethrough and an end cap coupled to a first end of the body; a retainer at least partially disposed within the bore proximate a second end of the body, wherein the retainer is configured to secure a wireline therein, the wireline comprising a plurality of individual wires; a rope socket disposed within the bore and having a first end and a second end, wherein the first end of the rope socket is adjacent the retainer, and wherein the rope socket is configured to receive the plurality of individual wires; a separator at least partially disposed within the rope socket and configured to separate the plurality of individual wires; a seal at least partially disposed within the rope socket; a pressure cap coupled to the second end of the rope socket, thereby compressing the seal and retaining the separator at least partially within the rope socket; a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires to form an electrical connection therebetween, wherein each terminal is configured to seal a terminal end of one of the plurality of wires, and wherein the end cap secures the conductor bundle within the electrical bulkhead housing.

20. The process according to paragraph 19, further comprising uncoupling a first end of the load cell from the end cap of the housing of the rope socket assembly, wherein the electrical connection is maintained when the rope socket assembly is uncoupled from the load cell.

21. The process according to paragraph 19 or 20, further comprising coupling a fishing module to an outer surface of the first section of the lower housing.

22. The process according to any one of paragraphs 19 to 21, wherein the electrical connection is maintained when any one of the rope socket assembly, the load cell, and the lower housing is detached from the wireline logging head.

23. The process according to any one of paragraphs 19 to 22, wherein the electrical connection is maintained when the rope socket assembly is uncoupled from the load cell.

24. The process according to any one of paragraphs 19 to 23, wherein each seal that seals the terminal end of one of the plurality of wires comprises an elastomer.

25. The process according to any one of paragraphs 19 to 24, wherein each seal that seals the terminal end of one of the plurality of wires forms a liquid tight seal about the terminal end of the wire.

26. The process according to any one of paragraphs 19 to 25, wherein each seal that seals the terminal end of one of the plurality of wires forms a liquid and gas tight seal about the terminal end of the wire.

27. The process according to any one of paragraphs 19 to 26, wherein each seal that seals the terminal end of one of the plurality of wires is electrically non-conductive.

28. The process according to any one of paragraphs 19 to 27, wherein the retainer is a wedge-type retainer, a ring-type retainer, a cone-type retainer, or a split-type retainer.

29. The process according to any one of paragraphs 19 to 28, wherein a motor is at least partially disposed within the lower housing and configured to uncouple the lower housing from the load cell when operated in a first direction and to couple the lower housing to the load cell when operated in a second direction.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. And if applicable, all patents, test procedures, and other documents cited in this application are fully incorporated by reference to the extent such disclosure is not inconsistent with this application and for all jurisdictions in which such incorporation is permitted.

While the foregoing is directed to certain illustrative embodiments, other and further embodiments can be devised without departing from the basic scope thereof, and the scope thereof is determined by the claims that follow.

What is claimed is:

1. A rope socket assembly for a wireline logging head, comprising:

a housing comprising a body having a bore formed therethrough and an end cap coupled to a first end of the body;

a retainer at least partially disposed within the bore proximate a second end of the body, wherein the retainer is configured to secure a wireline therein, the wireline comprising a plurality of individual wires;

a rope socket disposed within the bore and having a first end and a second end, wherein the first end of the rope socket is adjacent the retainer, and wherein the rope socket is configured to receive the plurality of individual wires;

a separator at least partially disposed within the rope socket and configured to separate the plurality of individual wires;

a seal at least partially disposed within the rope socket;

a pressure cap coupled to the second end of the rope socket, thereby compressing the seal and retaining the separator at least partially within the rope socket;

a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires and form an electrical connection therebetween, wherein each terminal is configured to seal a terminal end of one of the plurality of wires, and wherein the end cap secures the conductor bundle within the electrical bulkhead housing.

2. The rope socket assembly of claim 1, wherein the electrical bulkhead housing contains an electrically non-conducting fluid disposed about the conductor bundle.

3. The rope socket assembly of claim 1, wherein the end cap of the rope socket housing comprises a connector configured to couple to a load cell module.

4. The rope socket assembly of claim 1, wherein the rope socket housing comprises a connector configured to threadably couple to a load cell module.

5. The rope socket assembly of claim 1, wherein each seal that seals the terminal end of one of the plurality of wires comprises an elastomer.

6. The rope socket assembly of claim 1, wherein each seal that seals the terminal end of one of the plurality of wires forms a liquid tight seal about the terminal end of the wire.

7. The rope socket assembly of claim 1, wherein each seal that seals the terminal end of one of the plurality of wires forms a liquid and gas tight seal about the terminal end of the wire.

8. The rope socket assembly of claim 1, wherein each seal that seals the terminal end of one of the plurality of wires is electrically non-conductive.

9. The rope socket assembly of claim 1, wherein the retainer is a wedge-type retainer, a ring-type retainer, a cone-type retainer, or a split-type retainer.

10. A wireline logging head, comprising:

a rope socket assembly comprising:

a housing comprising a body having a bore formed therethrough and an end cap coupled to a first end of the body;

a retainer at least partially disposed within the bore proximate a second end of the body, wherein the retainer is configured to secure a wireline therein, the wireline comprising a plurality of individual wires;

a rope socket disposed within the bore and having a first end and a second end, wherein the first end of the rope socket is adjacent the retainer, and wherein the rope socket is configured to receive the plurality of individual wires;

a separator at least partially disposed within the rope socket and configured to separate the plurality of individual wires;

a seal at least partially disposed within the rope socket;

a pressure cap coupled to the second end of the rope socket, thereby compressing the seal and retaining the separator at least partially within the rope socket;

a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires to form an electrical connection therebetween, and wherein each terminal in the plurality of terminals comprises a seal that seals a terminal end of one of the plurality of wires, and wherein the end cap secures the conductor bundle within the electrical bulkhead housing;

a load cell having a first end and a second end, wherein the first end of the load cell is coupled to the end cap of the housing of the rope socket;

a lower housing having a first section detachably coupled to a second section, wherein the first section of the lower housing is coupled to the second end of the load cell; and an electronics cartridge at least partially disposed within the second section of the lower housing.

11. The wireline logging head of claim 10, further comprising a fishing module coupled to an outer surface of the first section of the lower housing.

12. The wireline logging head of claim 11, wherein the fishing module is a fishing bell housing, a housing with an external fishing neck, or a housing with an internal fishing neck.

13. The wireline logging head of claim 10, wherein the rope socket assembly, the load cell, and the lower housing are detachable from one another, and wherein the electrical connection is maintained when any one of the rope socket assembly, the load cell, and the lower housing is detached from the wireline logging head.

14. The wireline logging head of claim 10, wherein the electrical connection is maintained when the rope socket assembly is uncoupled from the load cell.

15. The wireline logging head of claim 10, wherein a motor is at least partially disposed within the lower housing and configured to uncouple the lower housing from the load cell when operated in a first direction and to couple the lower housing to the load cell when operated in a second direction.

16. The wireline logging head of claim 10, wherein the electrical bulkhead housing contains an electrically non-conducting material about the conductor bundle disposed within the electrical bulkhead housing.

17. The wireline logging head of claim 10, wherein the first section of the lower housing is rotatably connected to the second section of the lower housing.

18. The wireline logging head of claim 10, wherein the electronics cartridge includes a resistance temperature detector.

19. A process for assembling a wireline logging head, comprising:

coupling a first end of a load cell to an end cap of a housing of a rope socket assembly;

coupling a first section of a lower housing to a second end of the load cell, wherein the lower housing comprises the first section and a second section that are detachably coupled to one another; and disposing an electronics cartridge within the second section of the lower housing, wherein the rope socket assembly comprises:

a housing comprising a body having a bore formed therethrough and an end cap coupled to a first end of the body;

a retainer at least partially disposed within the bore proximate a second end of the body, wherein the retainer is configured to secure a wireline therein, the wireline comprising a plurality of individual wires;

a rope socket disposed within the bore and having a first end and a second end, wherein the first end of the rope socket is adjacent the retainer, and wherein the rope socket is configured to receive the plurality of individual wires;

a separator at least partially disposed within the rope socket and configured to separate the plurality of individual wires;

a seal at least partially disposed within the rope socket;

a pressure cap coupled to the second end of the rope socket, thereby compressing the seal and retaining the separator at least partially within the rope socket;

a sleeve disposed within the bore adjacent the second end of the rope socket, wherein a pressure compensating piston is at least partially disposed about the sleeve, and wherein an electrical bulkhead housing is disposed within the sleeve; and a conductor bundle disposed within the electrical bulkhead housing, wherein the conductor bundle comprises a plurality of terminals configured to receive the plurality of wires to form an electrical connection therebetween, wherein each terminal is configured to seal a terminal end of one of the plurality of wires, and wherein the end cap secures the conductor bundle within the electrical bulkhead housing.

20. The process of claim 19, further comprising uncoupling a first end of the load cell from the end cap of the housing of the rope socket assembly, wherein the electrical connection is maintained when the rope socket assembly is uncoupled from the load cell.

* * * * *